United States Patent [19]

Ezaki et al.

[11] 4,280,034

[45] Jul. 21, 1981

[54] VISUAL ANGLE ADJUSTABLE PORTABLE CASH REGISTER

[75] Inventors: Akira Ezaki; Yoshiaki Kobayashi; Sigeaki Hayashi, all of Nara, Japan

[73] Assignee: Sharp Kabushiki Kaisha, Osaka, Japan

[21] Appl. No.: 16,076

[22] Filed: Feb. 28, 1979

[30] Foreign Application Priority Data

Feb. 28, 1978 [JP] Japan ..... 53-26785[U]
Mar. 25, 1978 [JP] Japan ..... 53-38564[U]

[51] Int. Cl.[3] ..... G06C 5/02; G07G 1/00

[52] U.S. Cl. ..... 235/1 D; 235/7 R; 235/22

[58] Field of Search ..... 235/1 D, 7 R, 7 A, 22, 235/28, 1 R; 312/231, 233

[56] References Cited

U.S. PATENT DOCUMENTS

| | | | |
|---|---|---|---|
| 2,174,973 | 10/1939 | Dahlberg | 235/7 R |
| 2,436,773 | 2/1948 | Lambert | 312/231 |
| 2,529,475 | 11/1950 | Anneren | 235/1 D |
| 2,540,296 | 2/1951 | Schwend et al. | 235/1 D |
| 2,629,863 | 2/1953 | Stern et al. | 235/7 R |
| 2,841,899 | 7/1958 | Renfrow | 235/1 R |
| 3,047,350 | 7/1962 | Eckstein et al. | 235/1 D |
| 3,333,913 | 8/1967 | Heisler | 312/231 |
| 3,467,459 | 9/1969 | Wallis | 312/231 |

*Primary Examiner*—L. T. Hix
*Assistant Examiner*—Benjamin R. Fuller
*Attorney, Agent, or Firm*—Birch, Stewart, Kolasch & Birch

[57] ABSTRACT

A compact cash register comprises a first member for freely adjusting the visual angle of the same. The first member is connected to a second member of a casing of the compact cash register so as to provide in order to adjust the visual angle of the cash register. The first member comprises a ball biased continuously by a spring. The second member includes a cavity formed on the surface of a cover of the casing. The connection between the first member and the second member allows the compact cash register to be supported obliquely. The connection may be formed as a ratchet mechanism, a pivotal mechanism and the like. The casing comprises at least two compartments each containing the compact cash register and cash, the two compartments being adjacent to each other.

11 Claims, 3 Drawing Figures

VISUAL ANGLE ADJUSTABLE PORTABLE CASH REGISTER

BACKGROUND OF THE INVENTION

The present invention relates to a portable cash register and, more particularly, to a housing structure for a compact cash register of which the visual angle is freely selected for operating purposes.

The conventional cash register had no means for freely adjusting the visual angle therefor. However, since the conventional cash register was always positioned on a desk level and the like on account of its heaviness, it was not necessary to adjust the visual angle of the housing structure.

In recent years, however, it has become desirable to manufacture a cash register that is compact so that an operator can freely and conveniently carry the cash register. Thus, a compact cash register has been developed. Such a portable and compact cash register may be operated on a desk and the like which have a variety of heights. To increase operability of the portable cash register, it is more convenient that the portable cash register includes a member for freely selecting the visual angle of at least the operational units such as a keyboard unit, a display and the like.

OBJECTS AND SUMMARY OF THE INVENTION

Accordingly, it is a primary object of the invention to provide an improved portable and compact cash register having operational flexibility.

It is a further object of the invention to provide an improved portable and compact cash register housing comprising a calculating unit, a first compartment for containing a calculating unit, and a second compartment for containing money.

It is a further object of the invention to provide an improved portable and compact cash register which includes a member for freely selecting the visual angle of at least the operational units such as a keyboard unit, a display and the like.

It is a further object of the invention to provide a novel and useful housing for a compact cash register to adjust the visual angle of the cash register and to protect the cash register when not in use.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a portable and compact cash register housing of the present invention comprises a compact cash register as a calculating unit, a first compartment for containing the compact cash register, and a second compartment for containing cash.

The compact cash register comprises an adjustable member for freely selecting a visual angle of at least the operational units such as a keyboard unit, a display and the like. The adjustable member is positioned on at least one edge of the compact cash register. The adjustable member is provided for freely adjusting a connection portion between the compact cash register and the housing therefor while the compact cash register is being operated.

The adjustable member includes a ball biased continuously by a spring. The ball can be engaged with one of a series of recesses arranged in the housing. When the compact cash register is not operated, it is accommodated within the first compartment for protecting purposes. The housing can then be freely carried.

The adjustable member may be formed as a ratchet mechanism, a pivot structure and the like.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
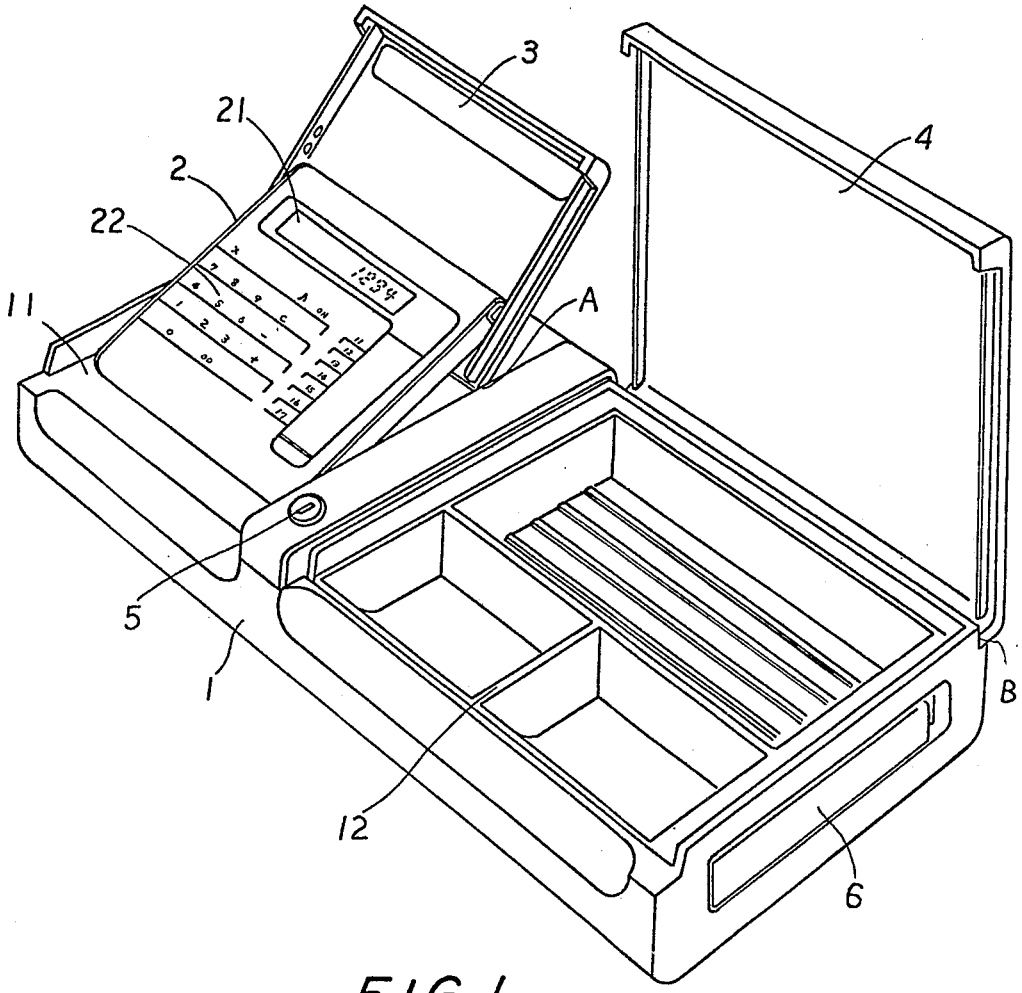
FIG. 1 is a perspective view of a combination of a portable casing and a compact cash register according to the present invention.

With reference to FIG. 1, there is illustrated a combination of a portable case 1 and a compact cash register 2 according to the present invention. The portable case 1 comprises an instrument container 11 and a cash container 12. The instrument container 11 is provided for accommodating the compact cash register 2. The cash container 12 is employed to store money.

The compact cash register 2 as a calculator includes a display 21, a keyboard unit 22 inclusive of digit keys and various functional keys, and a control circuit for conducting arithmetic calculations in response to data applied by actuation of the keyboard unit 22.

The portable case 1 further includes for the cash register 2 a power source such as a battery, and a printer for printing the manipulated data. The battery and recording paper for the printer can be exchanged through a back cover of the portable case 1 although the back cover is not shown. Power supply from the power source to the cash register is conducted through a cord member having a suitable length.

The cash container 12 comprises many compartments divided by parting strips to place notes and coins therein.

A cover 3 of the portable case 1 is provided for covering the compact cash register 2 when it is not operated and for adjusting a visual angle of the same in use. An end A of the cover 3 is pivotally supported by the portable case 1 for rotation.

Another cover 4 of the portable case 1 is provided for covering up the cash container 12. Another end B of the cover 4 is also supported by the portable case 1 in the same way as the end A to pivotally move the cover 4.

A key 5 is employed for keeping the covers 3 and 4 in a closed position. A pair of handles 6 function to carry the portable case 1 from one place to another. The handles 6 are both disposed in a sliding manner to draw out of the portable case 1 for carrying purposes.

Figure 2:
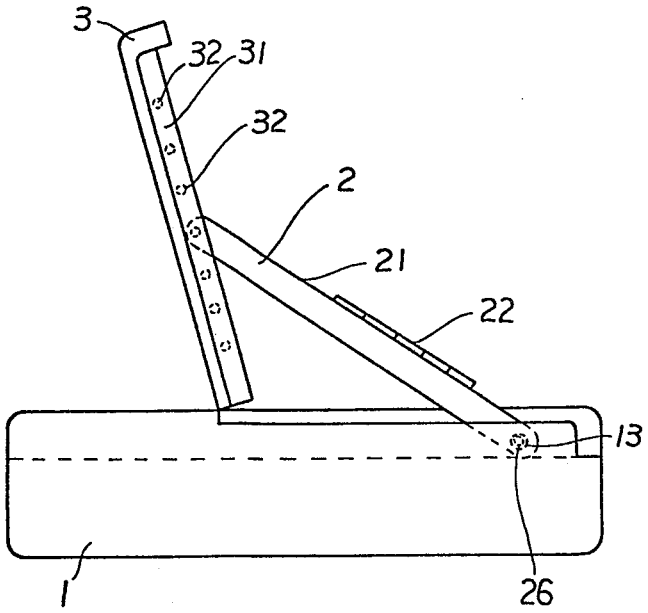
FIG. 2 is a side view of the combination shown in FIG. 1.
Figure 3:
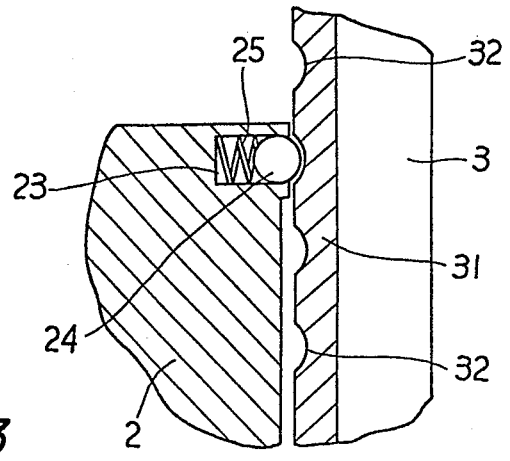
FIG. 3 is a sectional view of a connection portion between the portable case and the compact case register shown in FIG. 1.

With reference to FIGS. 2 and 3, a mechanism of the present invention for freely adjusting the visual angle of the compact cash register 2 is described in detail.

In FIG. 3, at the side of the display 21, there are formed a pair of recesses 23 for containing a ball 24 and a spring 25. The spring 25 functions to continuously stress the ball 24 outwardly from the compact cash register 2. The ball 24 remains positioned within the recess 23 against the spring 25. A suitable amount of the volume of the ball 24 is outside the surface of the compact cash register 2. On the other hand, a pair of frames 31 are disposed inside the cover 3, respectively. The frames 31 include a desired number of recesses 32 which can accept the ball 24 for engagement.

Referring to FIG. 2, at the other end opposed to the display 21, another pair of recesses are also provided in a similar manner as the recesses 23. The recess contain another ball 26 as well. A desired number of recesses 13 are provided within the instrument container 11 for engaging with the ball 26.

This arrangement provides for the adjustment of the compact cash register 2 with the aid of the engagement between the balls 24, 26 and the recesses 32, 13, respectively. In other words, the visual angle of the compact cash register 2 can be freely selected to thereby enhance operability of the cash register 2.

In the above-mentioned description, it has been recited that the power source is positioned within the portable case 1. However, since the compact cash register 2 as an calculator does dissipate a considerably small amount of power energy, as is well-known, the compact cash register 2 can contain the battery so that it also becomes portable.

Even if considerably strong stress is applied to the compact cash register 2, it can withstand this stress because of the engagement between the balls 24, 26 and the recesses 32, 13. This engagement can also be readily adjusted because the amount of the balls 24 and 26 extending from the recesses is adjustable. Ratchet means can be formed at the connection between the ball 26 and the recess 13 in the instrument container 11 instead. A pivotal member for the compact cash register 2 can be further provided at this connection within the instrument container 11, while the compact cash register 2 is continuously connected to the portable case 1 at one end thereof.

While only certain embodiment of the present invention have been described, it will be apparent to those skilled in the art that various changes and modifications may be made therein without departing from the spirit and scope of the invention as claimed.

What is claimed is:

1. A calculating machine unit, comprising:
calculating means having an outer housing; and
case means having an outer housing for retaining said calculating means therein, the outer housing of said case means being held in contact with one end of the outer housing of said calculating means at a first contacting point, said case means being a separate unit relative to said calculating means, said case means further including,
cash case means for storing currency therein, and
support means mounted to the outer housing of said case means for supporting the other end of said calculating means, said support means being held in contact with said other end of said calculating means at a second contacting point, said support means being movable to an angular position for selectively varying the angle of orientation of said calculating means relative to said case means.

2. A calculating machine unit in accordance with claim 1 wherein the location of said first contacting point is selectively variable for selectively increasing or decreasing said angle of orientation of said calculating means relative to said case means when said support means is moved to an angular position.

3. A calculating machine unit in accordance with claim 1 wherein the locations of the first and second contacting points are selectively variable for selectively increasing or decreasing said angle of orientation of said calculating means relative to said case means when said support means is moved to said angular position.

4. A calculating machine unit in accordance with claim 1 wherein the location of said second contacting point is selectively variable for selectively increasing or decreasing said angle of orientation of said calculating means relative to said case means when said support means is moved to said angular position.

5. A circulating machine unit in accordance with claim 3 wherein said case means comprises:
a first compartment means for retaining said calculating means; and
a second compartment means constituting said cash case means for storing said currency therein.

6. A calculating machine unit in accordance with claim 5 wherein one end of said support means is pivotably mounted in said first compartment of said case means, the other end of said support means being movable for selectively varying the angle of orientation of said calculating means relative to said case means.

7. A portable cash register for retaining currency therein, comprising:
a calculating means;
a case including a first area portion and a second area portion, said calculating means adapted to rest within said first area portion, said calculating means being unattached to and physically removable from said first area portion of said case when said calculating means rests therein, said second area portion including a plurality of compartment means for retaining said currency therein, said second area means having a cover securely disposed into engagement thereover.

8. A calculating machine unit in accordance with claim 5 wherein said first compartment means includes a first plurality of substantially parallel recesses disposed transversely across said first compartment means, said support means having a second plurality of substantially parallel recesses disposed transversely across the inside portion of said support means, said first plurality of substantially parallel recesses comprising a plurality of first contacting points, said second plurality of substantially parallel recesses comprising a plurality of second contacting points.

9. A calculating machine unit in accordance with claim 8 wherein said one end of the outer housing of said calculating means is placed in a selected one of said first plurality of substantially parallel recesses, said other end of the outer housing of said calculating means is placed in a selected one of said second plurality of substantially parallel recesses thereby selectively varying the locations of the first and second contacting points.

10. A portable cash register system capable of retaining currency, comprising:

calculating means for performing calculating operations; and receiving means for receiving said currency and calculating means therein, said receiving means including, a first area for receiving said calculating means therein, and a second area for retaining said currency therein, said calculating means being physically unattached to and resting within said first area of said receiving means when said calculating means is received therein.

11. A portable cash register system capable of retaining currency in accordance with claim 10, further comprising:

means for covering said second area thereby preventing said currency from falling out of said second area.

* * * * *